United States Patent [19]

Vanderlaan et al.

[11] Patent Number: 4,771,536

[45] Date of Patent: Sep. 20, 1988

[54] EXPANSION ROD MOUNTING STRUCTURE

[75] Inventors: Fred J. Vanderlaan, Ft. Wayne; Steven L. Stroup, II, Bluffton, both of Ind.

[73] Assignee: Crown Unlimited Machine, Inc., Bluffton, Ind.

[21] Appl. No.: 31,271

[22] Filed: Mar. 30, 1987

[51] Int. Cl.[4] ..... B23P 15/26

[52] U.S. Cl. ..... 29/727; 29/157.36; 29/523; 403/348; 403/353

[58] Field of Search ..... 29/33 G, 33 T, 157.3 B, 29/157.3 C, 726, 727, 523; 165/150; 403/323, 348, 353

[56] References Cited

U.S. PATENT DOCUMENTS

| | | | |
|---|---|---|---|
| 2,023,736 | 12/1935 | Mason et al. . | |
| 2,701,114 | 2/1955 | Donaldson | 403/353 X |
| 3,487,523 | 1/1970 | Ames . | |
| 3,824,668 | 7/1974 | Wightman | 29/727 |
| 4,483,563 | 11/1984 | van der Heyden | 403/348 X |
| 4,597,171 | 7/1986 | Kitayama et al. | 29/727 |

FOREIGN PATENT DOCUMENTS

| | | | |
|---|---|---|---|
| 2705632 | 8/1978 | Fed. Rep. of Germany | 29/157.3 B |

*Primary Examiner*—P. W. Echols

*Assistant Examiner*—Andrew E. Rawlins

*Attorney, Agent, or Firm*—Pearne, Gordon, McCoy & Granger

[57] ABSTRACT

A rod mounting system for mounting expander rods in tube expander machines is disclosed. The mounting structure includes an opening in a header sized to receive the end of a mounting rod. A key extends into the opening from one side thereof. The rod end is provided with two longitudinally extending keyways and a peripheral groove. The first keyway extends from the end of the rod to an end face aligned with the peripheral groove. The second keyway extends from a location spaced from the end of the rod in both directions beyond the peripheral groove. The rod is installed in the header by longitudinal movement in an installation and removal orientation in which the key is aligned with the first keyway. When the rod engages the inner end of the first keyway, it is rotated to position the second keyway and the key in alignment. In such orientation, the rod is locked within the header for movement between two limits of longitudinal movement. In each limit position, the second keyway and key cooperate to prevent rotation to the released orientation. The keyways and key are sized and positioned to permit an operator to install and remove rods without tools from a position remote from the header.

9 Claims, 3 Drawing Sheets

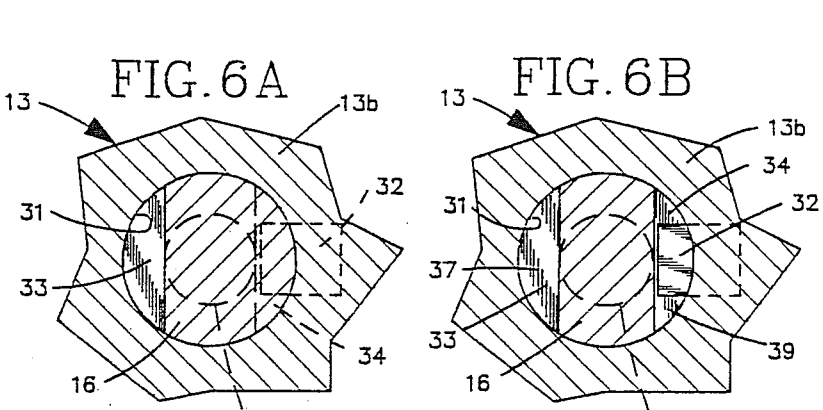
FIG. 6A
FIG. 6B
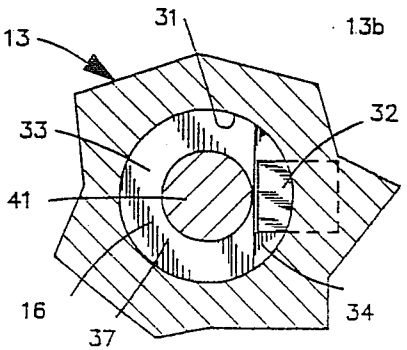
FIG. 6C
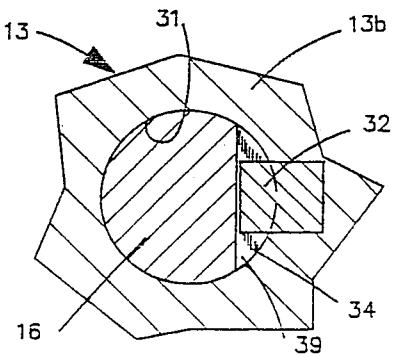
FIG. 6D
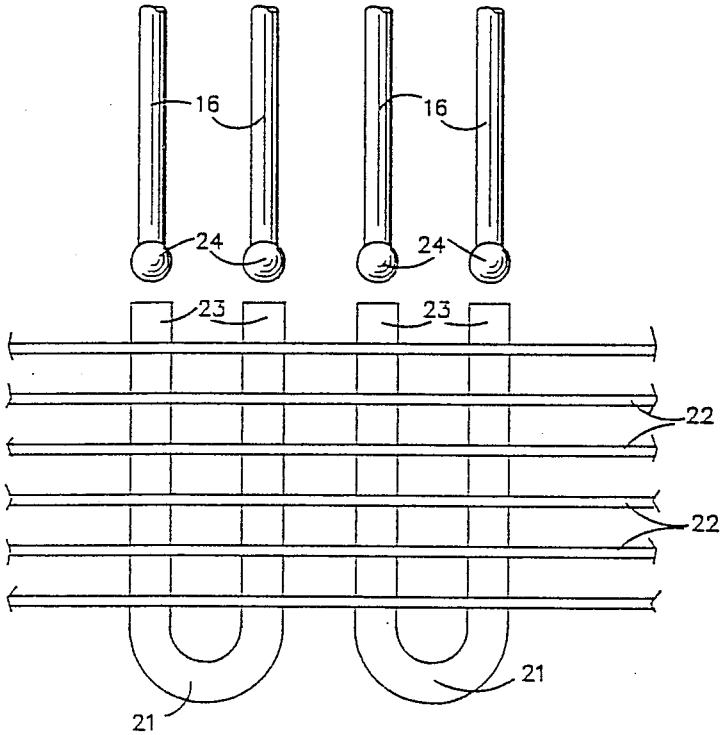
FIG. 2

EXPANSION ROD MOUNTING STRUCTURE

BACKGROUND OF THE INVENTION

This invention relates generally to machines for expanding heat exchanger tubes and the like to interlock such tubes with fins positioned around said tubes, and more particularly to a novel and improved structure for removably mounting expander rods in such machine.

PRIOR ART

It is known to manufacture heat exchangers and the like by assembling fins on tubes or hairpins with a loose fit and then expanding the tubes or hairpins to produce a tight fit with the fins and permanently lock the assembly together. This also provides good heat exchange contact between the tubes and the fins.

Generally, expander machines provide a frame having an assembly fixture or nest at one end for holding the loosely assembled tubes and fins and a powered header or ram at the other end. Mounted on the powered ram are a plurality of expander rods aligned with the tubes in the fixture or nest. The ends of the rods are formed with expander ends or bullets sized to move along the tube as the ram advances and to expand the tube into tight fitting engagement with the openings in the fins. Examples of such machines are illustrated in U.S. Pat. Nos. 2,023,736 and 3,487,523, which are incorporated herein by reference.

The latter-mentioned of such patents describes a structure for removably mounting the expander rods in a header. Such structure includes a power-operated, shiftable plate for releasably locking the rods in their installed position. Such system requires a relatively complex rod support and mounting system. It is also known to provide a spring-loaded detent system to releasably lock the expander rods in position within the header. In such system, it is necessary to insert a tool along the side of the rod to release the detent when expander rods are removed. This is quite time-consuming and is particularly difficult in vertical machines, which usually require the worker to stand on a ladder while releasing the locking system.

SUMMARY OF THE INVENTION

The present invention provides a novel and improved releasable rod mounting structure particularly suitable for releasably mounting expander rods in machines for producing heat exchangers and the like.

In accordance with the present invention, a header is provided with rod-receiving openings sized to receive the end of an expander rod and providing a key extending into the opening from one side thereof. The rod end is shaped so that the rod can be moved lengthwise into the header opening in a first rotational orientation, hereinafter often referred to as the "installation and removal orientation." The rod is then rotated through 180 degrees, in the illustrated embodiment, to a locked orientation in which the key operates to lock the rod against removal from the header.

In such locked position, the rod is longitudinally movable through a short distance between an inward limit position and an outward limit position. In both limit positions, the key operates to prevent rotation of the rod from the locked orientation so that the rod remains locked in the header.

Removal of a given rod is accomplished by longitudinally moving the rod to an intermediate position substantially half-way between the two limit positions. In such intermediate position, the rod is free to rotate back to the installation and removal orientation in which the key is disengaged and the rod is free for longitudinal movement out of the header opening.

With this invention, the expander rods can be easily installed in or removed from the header without tools. In fact, it is not necessary for the operator to stand on a ladder during such installation or removal, even on vertical machines in which the rods are mounted substantially above the floor level. Further, the mounting structure does not require any powered or non-powered moving parts.

In the illustrated embodiment, the rods are provided with a first flat or keyway on one side thereof extending longitudinally from the end of the rod. On the opposite side, the rod provides a similar second flat or keyway which extends lengthwise of the rod and is spaced from the rod end. Intermediate the ends of the second flat or keyway, the rod provides a circular portion of reduced diameter providing a peripheral groove joining the two flats or keyways. Such grooves and flats are sized in proportion with respect to the key to allow installation by simple insertion of the rod while in the installed orientation, and then rotation to the locked orientation to complete the installation. When the machine is in the vertical position, gravity causes the rod to move to its extended limit, in which the key engages the end of the second keyway. This provides the installer with an indication that the installation has been completed in a satisfactory manner. In other types of machines, such as horizontal machines, the installer merely pulls or pushes on the rod as it is rotated so that an indication is provided that correct positioning of the rod in its locked orientation is achieved. In such locked orientation, the key is aligned with the second keyway and the rod can move longitudinally to the limit position.

These and other aspects of this invention are illustrated in the accompanying drawings and more fully described in the following specification.

BRIEF DESCRIPTION OF THE DRAWINGS

FIG. 2 is a fragmentary, schematic illustration of the relationship between the tube and fin assembly and the expander rods prior to the expanding operation of the tube;

FIG. 6A is a fragmentary section taken along line 6A—6A of FIG. 3;

FIG. 6B is a fragmentary section taken along line 6B—6B of FIG. 3;

FIG. 6C is a section taken along line 6C—6C of FIG. 3; and

FIG. 6D is a section taken along line 6D—6D of FIG. 3.

DETAILED DESCRIPTION OF THE DRAWINGS

Figure 1:
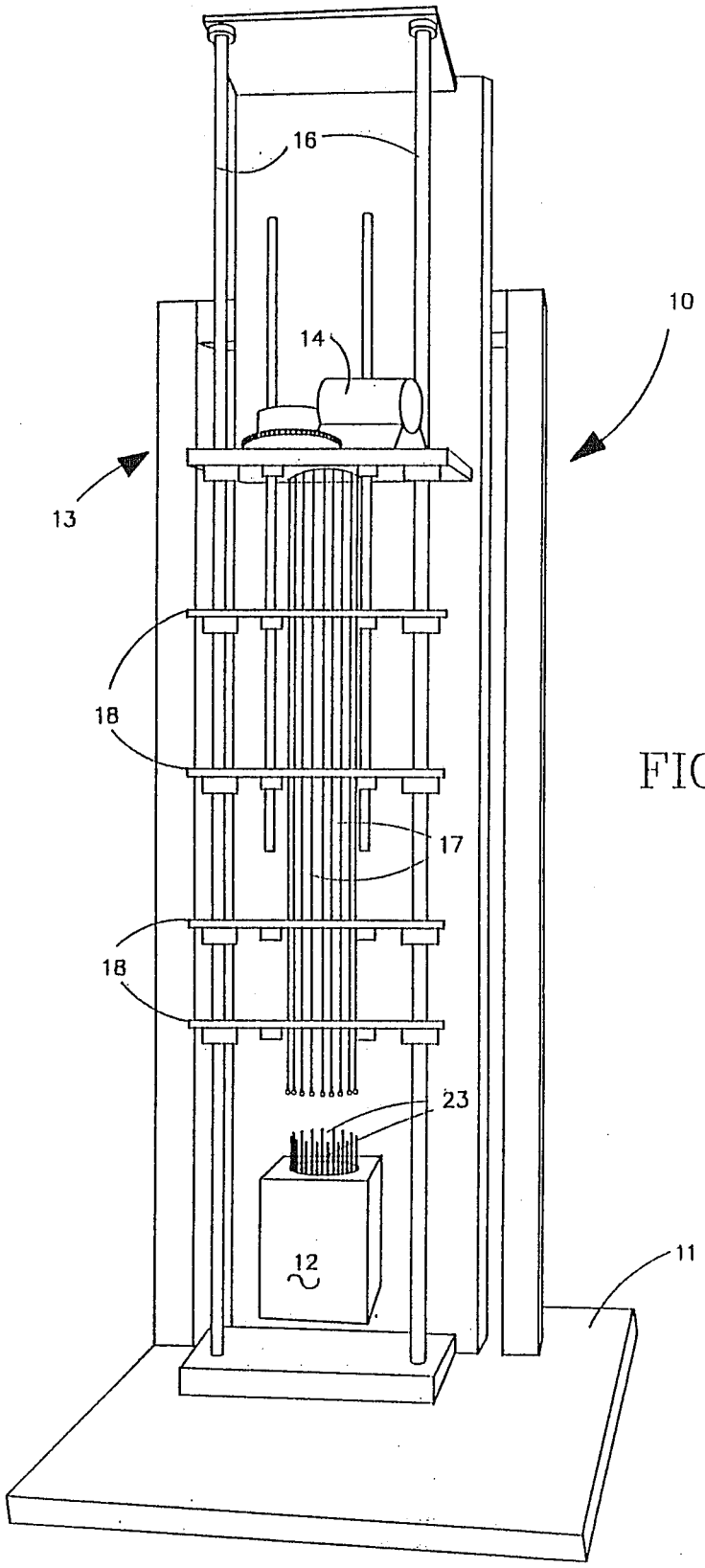
FIG. 1 is a schematic, perspective view of a complete expander machine incorporating an expander rod mounting structure in accordance with the present invention.

Referring to FIG. 1, a typical vertical expander machine of the type to which the present invention is particularly suited provides a frame 10 supported on a base 11. Mounted at the lower end of the frame is a fixture 12, often referred to as a "nest" in which heat exchanger tubes and fins are assembled in a loose condition. Positioned at the upper end of the frame is a header or ram 13 which is vertically movable by a power drive 14 along guide rods 16. Mounted at their upper ends in the header 13 are a plurality of expander rods 17 which extend through floating guides 18 that position the lower ends of the rods in alignment with the tubes contained within the fixture or nest 12.

FIG. 2 schematically illustrates an assembly of hairpin tubes 21 and fins 22 of the type which may be be assembled within the fixture 12. The fins are sized to loosely receive the parallel legs 23 of the hairpin tubes 21. The openings (not illustrated) within the fins through which the tube legs 23 extend are sized so that prior to the expansion of the tube, a loose fit is provided for easy assembly. However, after the tubes are expanded, a tight mechanical engagement is provided between the tube legs and the openings in the fins to create a permanent assembly and to provide good heat conducting interengagement between the fins and the tubes.

Positioned above each tube leg 23 is an expansion rod 16 provided with an enlarged expander end 24, sometimes referred to as a "bullet." When the machine is operated to expand the tube, the header 13 is lowered, causing the enlarged ends 24 of the expander rods to enter the tubes and expand the tubes. Such motion is continued until the enlarged ends 24 move down along the tubes past all of the fins. After such expansion, the header is raised to lift the rods back out of the tubes to complete the operating cycle of the machine.

The machine and the operation thus far described are conventional and form no part of this invention, except to the extent that they relate to the mounting of the ends of the expander rods 16 in the ram or header 13.

Reference should now be made to FIGS. 3–6D, which illustrate the structural detail of the expander rod mounting system. The header 13 in the illustrated embodiment consists of an assembly of three plates **13*a*, 13*b*, and 13*c*, which are assembled as a unit. An expander tube mounting opening 31 is provided for each expander tube, and extends through the two plates 13*b* and 13*c*. Such opening 31 is cylindrical in shape, and is sized to closely fit the upper end of the associated expander rod 16**.

Positioned in the plate **13*b* at a location spaced from the plate 13*a* is a fixed key 32 which extends a small distance into the opening 31 at a location spaced from both ends of the opening. It should be understood that the expander rod 16, the opening 31, and the key 32** are illustrated at an extremely enlarged scale, and that the diameter of the expander rod may be in the order of 3/16 inch.

The upper end of the expander rod is provided with first and second keyways 33 and 34, respectively, which in the illustrated embodiment are longitudinally extending flats. The first keyway 33 extends from the end 36 of the expansion rod to an end face 37. Similarly, the second keyway 34 is formed as a flat extending from an outer end face 38 to an inner end face 39. The rod is further formed with a center portion 41 of circular cross section extending from an upper end 42 to a lower end 43 aligned with the end face 37. The diameter of this circular portion 41 is equal to the lateral spacing between the flats of the keyways 33 and 34.

Figure 3:
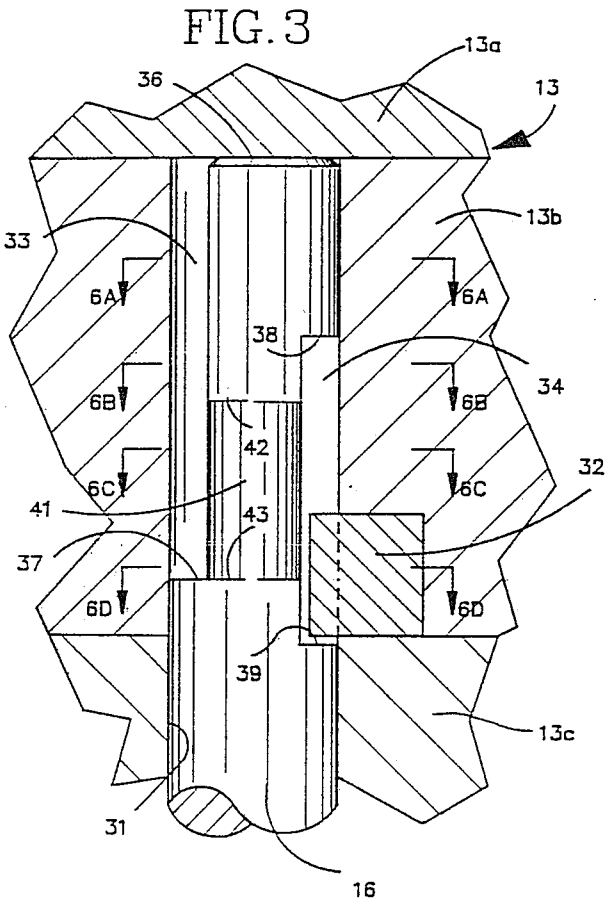
FIG. 3 is an enlarged, fragmentary view partially in section, illustrating an installed expander rod at its inner limit of movement.

FIG. 3 illustrates the expander rod in its mounted position within the header 13 when the header is being lowered to drive the expander rod down into the parallel legs of the hairpin tube 21. In such condition, the end face 36 of the rod engages the plate **13*a*, which provides one limit of movement of the rod with respect to the header and provides a good surface engagement for producing the required driving force on the rod to move the rod down into the tubes which are being expanded. Preferably, the key is located and sized so that a small space exists between the end face 39 and the key 32 to ensure that the force required for driving the expander rod 16 into the tube is not carried by the key 32**.

Figure 4:
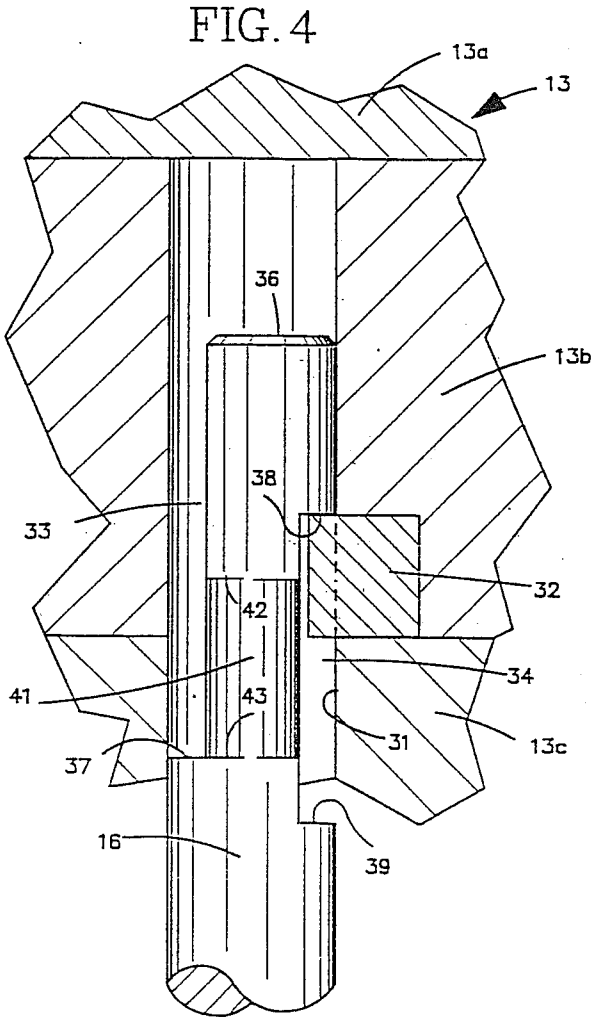
FIG. 4 is a fragmentary section similar to FIG. 3, illustrating an installed expander rod at its outward limit of movement.

After the expanding operation is completed by downward movement of the header 13, the header is raised to lift the rods back out of the tube. At this time, the header 13 moves a short distance relative to the rod until the key 32 engages the end face 38 of the second keyway 34, as illustrated in FIG. 4. This limits the relative movement between the header 13 and the expander rod, and as the header continues to be raised, the expander rod is withdrawn from the tube.

Because the keyway 34 extends in both directions beyond the peripheral groove provided by the circular portion 41, so that the key 32 is positioned beyond the peripheral groove in both limits of movement, the expander rod is locked against rotation from the locked orientation to the installation or removal orientation. For example, during the expanding operation illustrated in FIG. 3, the keyway 34 cooperates with the key 32 to prevent rotation of the expander rod. Similarly, on the withdrawal cycle illustrated in FIG. 4, the key 32 extends up along the keyway 34 so that the expander rod is again locked against rotation.

Figure 5:
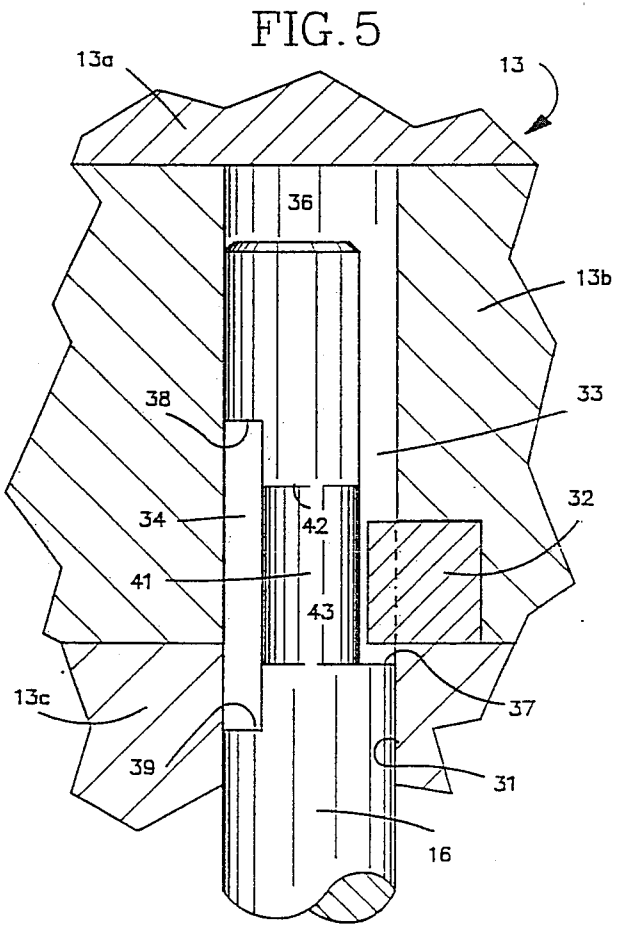
FIG. 5 is a fragmentary section similar to FIGS. 3 and 4, illustrating an expander rod positioned in its installation and removal orientation.

FIG. 5 illustrates the position of the elements during installation or removal when the expander rod 16 has been rotated through 180 degrees to the installation or removal orientation. In such orientation, the key 32 is located in the keyway 33 so that the expander rod can be removed from the header 13.

Assuming that FIG. 5 illustrates an intermediate point in the installation procedure, the expander rod is inserted into the opening 31 as the initial step of installation of the rod. If the orientation is not correct, the key 32 engages the end 36 of the rod and prevents full insertion. The installer is then aware that incorrect orientation exists because the rod does not move fully into the opening. The installer then merely rotates the rod until the key 32 and the keyway 33 are properly aligned. This allows the rod to move further into the opening 31 and provides the installer with an indication that the orientation is correct for installation. The operator then moves the rod upwardly into the opening 31 until the key 32 engages the end face 37 of the keyway 33. Because such end face is aligned with the peripheral groove, proper alignment exists for rotation of the rod to the installed or locked orientation. In such rotation, the key is cleared by the peripheral groove in the rod, so free rotation exists. During such rotation, the operator either maintains an upward force on a rod or allows gravity to produce a downward force on the rod. In either event, as soon as the expansion rod has been rotated to the locked orientation, so as to align the key 32 with the keyway 34, the rod moves longitudinally to establish that proper installation has been completed, and the rod is maintained in its installed position by the cooperation between the key 32 and keyway 34.

When it is desired to remove a rod, the installer merely applies a light rotary force to the rod, and moves it axially from the limit position to an intermediate position in which the peripheral groove is aligned with the key. As soon as proper axial position is reached, the rotary force applied by the operator causes the rod to rotate, providing an indication that the rod is in the proper position for rotation to the release orientation. As the rod is rotated, a longitudinal force is applied by gravity, or by the operator, in the removal direction, and as soon as the keyway 33 is aligned with the key 32, the rod automatically moves outwardly and is removed. With this invention, it is not necessary for the operator to be visually aware of the orientation, and it is a simple matter for the installer to complete installation or removal without the use of tools of any type. Further, it is not necessary for the operator to stand on a ladder so as to be located next to the header, even in vertical machines.

It should be understood that although the present invention is illustrated in connection with a vertical machine, it is equally applicable to horizontal machines, and that the present invention is not limited to the vertical mounting of the rods.

Although the preferred embodiment of this invention has been shown and described, it should be understood that various modifications and rearrangements of the parts may be resorted to without departing from the scope of the invention and disclosed and claimed herein.

What is claimed is:

1. A tube expander machine for expanding tubes into tight fitting engagement with fins, comprising a frame, a nest on said frame for positioning loosely fitting fins and tubes, a header on said frame, power means for moving said nest and header toward and away from each other, and an expander rod associated with each tube operable to enter an associated tube when said nest and header move toward each other and to expand said tubes into tight fitting engagement with said fins, said rods and header providing cooperating locking means for releasably mounting the ends of said rods on said header, said locking means including for each rod an opening in said header sized to receive the end of an associated rod with a close fit, a key projecting into each opening from one side thereof, each rod providing a longitudinally extending first keyway extending from one end of each rod sized to receive one of said keys and permit movement of said rod into said opening when said rod is in a first orientation relative to said opening, each rod also providing a second keyway spaced from said one end of said rod, and a peripheral groove joining said keyways, said peripheral groove being sized to clear said key and permit rotation of said rod between said first orientation and a locked orientation in which said key is positioned in said second keyway, said second keyway extending longitudinally beyond said peripheral groove in at least one direction, permitting movement of said rod to a limit position in which said key extends along said second keyway beyond said peripheral groove, said second keyway cooperating with said key to prevent removal of said rod from said opening when said rod is in said locked orientation and preventing rotation of said rod from said locked orientation when said rod is in said limit position.

2. A tube expander machine as set forth in claim 1, wherein said second keyway extends beyond said peripheral groove in both directions and allows longitudinal movement of said rod between spaced limit positions, said second keyway and key cooperating to prevent rotation of said rod from said locked position in both of said limit positions.

3. A tube expander machine as set forth in claim 1, wherein said opening provides an inner end, the end of said rod engaging said inner end when said rod is in said limit position to absorb inwardly directed forces on said rod and preventing inwardly directed forces from being absorbed by said key.

4. A tube expander machine as set forth in claim 3, wherein said second keyway extends beyond said peripheral groove in both directions and allows longitudinal movement of said rod between spaced limit positions, said second keyway and key cooperating to prevent rotation of said rod from said locked position in both of said limit positions.

5. A tube expander machine as set forth in claim 4, wherein said key engages an end of said second keyway to prevent movement of said rod past one of said limit positions in the direction out of said opening.

6. A tube expander machine as set forth in claim 5, wherein said first keyway provides an inner end aligned with said peripheral groove to limit inward movement of said rod along said opening when said rod is in said first orientation and aligns the key with said peripheral groove during installation of said rod in said opening.

7. A tube expander machine as set forth in claim 6, wherein said rod is a tube expander rod and said header is part of a tube expander machine for securing the fins on tubes.

8. A tube expander machine for expanding tubes into tight fitting engagement with fins, comprising a frame, a nest on said frame for positioning loosely fitting fins and tubes, a header on said frame, power means for moving said nest and header toward and away from each other, and an expander rod associated with each tube operable to enter an associated tube when said nest and header move toward each other and to expand said tubes into tight fitting engagement with said fins, said rods and header providing cooperating locking means for releasably mounting the ends of said rods on said header, said cooperating locking means permitting installation and removal of rods on said header while said rods are in a first rotational orientation and rotation between said first rotational orientation and a second rotational orientation, said locking means locking said rods on said header while said rods are in said second rotational orientation, said rods being longitudinally movable between first and second limits of movement while said rods are in said second rotational orientation, said locking means preventing rotation of said rods to said first rotational orientation when said rods are in either of said limits of movement.

9. A tube expander machine as set forth in claim 8, wherein said rods are rotatable between said first and second rotational orientation when said rod is in an intermediate position between said limits of movement.

* * * * *